United States Patent [19]

Luch

[11] Patent Number: 4,603,092

[45] Date of Patent: Jul. 29, 1986

[54] METAL-POLYMER COMPOSITE

[76] Inventor: Daniel Luch, 6 Fairview Ave., Warwick, N.Y. 10990

[21] Appl. No.: 574,474

[22] Filed: Jan. 27, 1984

Related U.S. Application Data

[63] Continuation-in-part of Ser. No. 279,255, Jul. 1, 1981, Pat. No. 4,429,020, which is a continuation-in-part of Ser. No. 152,344, May 22, 1980, abandoned.

[51] Int. Cl.[4] ..... C25D 5/10; C25D 5/56

[52] U.S. Cl. ..... 428/626; 428/625; 428/461.1

[58] Field of Search ..... 428/626, 461, 625

[56] References Cited

U.S. PATENT DOCUMENTS

| | | | |
|---|---|---|---|
| 3,868,229 | 2/1975 | Hurley | 204/41 X |
| 3,926,569 | 12/1975 | Hage | 29/194 |
| 4,009,093 | 2/1977 | Luch | 252/510 |
| 4,191,617 | 3/1980 | Hurley et al. | 428/678 |
| 4,195,117 | 3/1980 | Luch | 428/626 |
| 4,429,020 | 1/1984 | Luch | 428/626 |

OTHER PUBLICATIONS

Zartan, Tech. Bull. Nos. 7611 (4 pages) and 7614, plus Fact Sheet, Hood Chem. Co.

*Primary Examiner*—Veronica O'Keefe

[57] ABSTRACT

Metal-polymer composite articles, e.g., knobs, nuts, trimmings or ornaments, enclosures for electronic devices, hardware items, plumbing components, household furnishings, and automotive components including grills, headlamp bezels and surrounds, wheel covers, trim, hubs and like parts, having silvery hued metal surfaces comprise surface plating composed essentially of an alloy of tin and Group VIII metal that is durably joined to a supportive solid body containing a directly electroplateable polymeric material, e.g., a composition wherein carbon black and sulfur are combined with a polymer. Polyvinyls, polyolefins, polystyrenes, elastomers, polyamides and polyesters are among the suitable polymers. A durably adherent layer of nickel-based metal is disposed between the body and the surface plating. Durability of the surface plating includes resistance to thermal cycling and to salt spray corrosion. Disclosure includes process whereby article is prepared with electroplating of nickel-based and tin-based metal strata to provide desirable composite articles expeditiously at low cost for high quality production.

4 Claims, 1 Drawing Figure

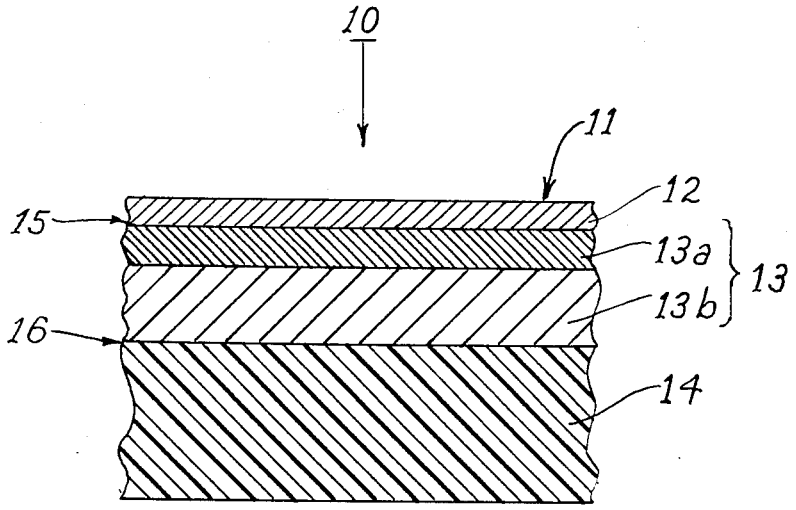
10
11
12
15
13a
13
13b
16
14

METAL-POLYMER COMPOSITE

This application is a continuation-in-part of my copending U.S. application Ser. No. 279,255 filed July 1, 1981, (now U.S. Pat. No. 4,429,020) which is a continuation-in-part of my U.S. application Ser. No. 152,344 filed May 22, 1980 and now abandoned.

The present invention relates to composite articles and more particularly to providing metal-surfaced polymeric articles.

Many articles, e.g., knobs, nuts, ornaments and urns, enclosures for electronic devices, hardware items including tape cases and machine housings, plumbing components including faucet enclosures, control handles, fittings and trim, household furnishings such as lamp housings, frames, drapery fixtures and appliance knobs and trim, and automotive components including grilles, headlamp bezels and surrounds, wheel covers, exterior trim, hubs and interior latches and trim, are made of polymers (sometimes called plastics or resins). Frequently it is desired that polymeric articles have adhering metal surfaces for benefits such as appearance and cleanliness. Also, in at least some instances, metal surfacing is desirable for protection, smoothness and possibly for imparting rigidity to the part. Adherent metal surfacing may also be used on polymeric substrates to provide shielding against electromagnetic radiation. Very often, silvery hued or colored surfaces such as those like freshly cleaned steel or brightly polished silver are desired.

Long term integrity of the composite is normally required. Durability of desired characteristics is an important consideration. The surface metal should be stable to maintain the desired color and continuity; and, accordingly, should resist corrosion, tarnish or other discoloration and avoid blistering, cracking or other undue deterioration. Moreover, the metal-polymer structure should have endurance to certain environmental variations, e.g., elevated temperatures, sub-zero temperature, salt water splashes, and alkaline detergents.

Economy of production must also be considered and in this respect shorter production times, fewer steps, simplicity and avoiding waste disposal difficulties are desirable advantages.

Heretofore, various metal coating methods, e.g., vapor deposition, metal lamination, chemical plating, and electroplating, have been used on some polymers. Still, for providing metal-surfaced polymeric articles, there are unfilled needs for achieving desired production economy and product quality, particularly including adherent durability of plating with desired color. Attempts at obtaining improved results have often involved adding specialized layers of metal or other material and thus, whatever the intended benefits, introduced undesirable complexity, production costs and often unintended detrimental effects from the specialized material.

A promising approach to the production of metal-surfaced polymeric bodies was disclosed by Luch in U.S. Pat. Nos. 3,865,699 and 4,009,093. In these disclosures Luch taught the use of polymeric compositions, containing carbon black, sulfur and polymer matrix, as substrates that could be directly electroplated without pretreatment.

Because of its resistance to abrasion and tarnish, relative ease of application and reasonable cost, electroplated chromium has achieved almost universal acceptance as an exterior electrodeposit to provide a silvery-hued color where long-term durability is required. Thus, prior endeavors have tried electroplated chromium to provide silvery-hued exteriors on bodies of directly electroplateable polymers which contain carbon black and sulfur in a polymeric matrix. For example, nickel/chromium electrodeposits on polymeric substrates, including directly electroplateable substrates, were suggested by Luch (U.S. Pat. Nos. 3,865,699 and 4,009,093) and Hurley (U.S. Pat. No. 3,868,229).

Efforts at commercial development of directly electroplateable polymers, after the initial disclosures by Luch, revealed that the bond joining an electrodeposit to a directly electroplateable polymeric substrate containing sulfur and carbon black can deteriorate with age. This possible bond deterioration was recognized when electroplated samples were examined after long periods (about two years or more) of storage and exposure. Many possible causes have been advanced for the bond instability phenomenon of directly electroplateable polymers. No explanation appears complete and therefore the cause remains mainly speculative, defying a priori solutions. Indeed, all of the solutions to this problem remain to this date largely empirical and unpredictable.

Recognition of the bond instability phenomenon, along with absence of predictable solutions, led to definition of an accelerated test, termed the "heat soak thermal stability" (HSTS) test, to predict the tendency and extent of bond instability with changes in composite structure and processing. The test consists of placing an electroplated "directly plateable" part at 85° C. for 16 hours, normalizing to room temperature and either evaluating residual adhesion or placing at −30° C. to test for blistering tendencies. This HSTS test has been found far more severe for directly electroplateable resins than the three or four combined thermal cycle/CASS cycles used for electroplated ABS. Nevertheless, the HSTS test has been adopted as an acceptance test for electroplated "directly electroplateable" plastics where long-term (e.g. two years or more) durability against thermal shock and thermal cycling is required. The test is described in U.S. Pat. Nos. 4,195,117 (Luch) and 4,191,617 (Hurley, Luch, and Knipple).

It is now known that neither the "all nickel" electrodeposits proposed by Hurley for ABS substrates (U.S. Pat. No. 3,868,229) nor the "all nickel" electrodeposit of Luch's Example V (column 9, lines 34–41 of U.S. Pat. No. 4,009,093), when applied to a directly electroplateable substrate, would acceptably pass the HSTS test and therefore would be unsatisfactory for use where long term durability against thermal shock and thermal cycling is required. This fact lead to the insertion of a copper interlayer, after initial plating of a directly electroplateable polymer with nickel and before finishing with nickel plus chromium. Copper interlayers have long been recognized for their beneficial effects on performance of electroplated plastics under thermal cycling conditions and copper interlayers were found to give improved performance for directly electroplateable plastics in the HSTS test. It was found however that acceptable performance in the HSTS test could not be consistently achieved on all parts having various complex geometries even when relatively thick copper layers were employed.

Inconsistent performance of the composite structure (directly electroplateable plastic/nickel/copper/nickel/chromium) in HSTS stimulated development of nickel alloy strike coatings as disclosed in U.S. Pat. Nos. 4,191,617 and 4,195,117. Parts of simple design, capable of surviving the 16 hour/85° C. (HSTS) test (and therefore suitable for use where long term durability against thermal shock and thermal cycling is required), were prepared under closely controlled plating conditions in a laboratory by first plating a directly electroplateable substrate with nickel/cobalt (or nickel/iron) and subsequently applying an all-nickel plus chromium electrodeposit. However, the good HSTS results achieved with laboratory plating on simple parts could not be obtained with more variable production plating. Furthermore, the nickel alloy strike followed by all-nickel plus chromium electrodeposit was unstaisfactory on parts of complex design. Specifically, deeply recessed areas experiencing low current densities during electrodeposition or those areas having a tortuous potential path to the anode were particularly unacceptable in the HSTS test when plated with a nickel alloy strike followed by all-nickel plus chromium. Many parts, including automotive parts such as grilles, lamp frames and other trim have such areas and these parts failed the HSTS when plated with nickel alloy strike+all-nickel+chromium. In another proposed application, electrodeposits used to shield an enclosure against electromagnetic radiation might lead to failure of the enclosed device if delamination occurred in low current density areas of the enclosure. Thus the nickel alloy strike coatings did not permit applying "all-nickel plush chromium" electrodeposits on many production parts for use where long term durability against thermal shock and thermal cycling is required. In order to achieve consistently acceptable performance in the HSTS test in production and on complicated parts, it was necessary to reimpose a copper interlayer after the initial nickel alloy strike.

Thus, for those applications where long-term durability against thermal shock and thermal cycling is required, current art offers the following composite structure: directly electroplateable substrate/nickel alloy strike/copper/nickel/chromium. This composite system suffers from a number of inherent deficiencies as follows. (1) The copper interlayer bleeds objectionable green corrosion products when corrosive media penetrates to it. Thus, when used in corrosive environments such as exterior automotive, a relatively thick multilayered nickel deposit is necessary to protect the copper. Extended electroplating times may be required for such protection in deeply recessed areas. (2) Use of a copper interlayer significantly complicates the overall electroplating process. Multiple rinsing, acid dips and reverse current cleaning baths are generally recommended to prevent adhesion difficulties between copper and nickel. (3) Acid copper baths have the tendency to undercut the very thin nickel alloy strike deposits, especially in recessed, low current density areas. Thus, extended strike times are often required on complicated parts to ensure a strike layer thickness adequate to prevent undercutting by acid copper. These difficulties add up to significantly reduce the economic savings achievable via use of directly electroplateable plastic substrates.

There has now been discovered a new metal-polymer composite article and a process for production thereof that enhance progress in overcoming difficulties in the metal-polymer composite art, and specifically those difficulties which have impeded selection of directly electroplateable polymers for metal-polymer composites for use in applications where long-term durability against thermal shock, thermal cycling and corrosion is required.

An object of the present invention is to provide a new metal-polymer composite article.

Another object of the present invention is to provide a process for accomplishing a new combining of metal and polymer.

Objects and benefits of the invention will also become apparent from the following description and accompanying drawing, which depicts a partial cross-section of an embodiment of the composite article of the invention.

The present invention contemplates a composite article having a body component, at least part of whose surface is a directly electroplateable polymeric surface; an exterior stratum made of a silvery hued alloy comprising tin and metal chosen from Group VIII of the Periodic Table of Chemical Elements (Group VIII metal), advantageously a silvery hued tin-based tin/cobalt alloy, or a silvery-hued tin-based tin/nickel alloy, or combinations thereof; and an interior stratum located between and durably joined to both the directly electroplateable polymeric surface of the body component and the exterior stratum to maintain the exterior stratum in a desired position in relation to the body. The interior stratum includes a nickel-based layer adherent to the directly electroplateable polymeric surface and can also include more layers durably joined among themselves.

Herein, "nickel-based" refers to metals (including alloys) containing, by weight, 50% to 100% nickel, and similarly, tin-based refers to metals containing 50% or more tin. Also, "alloy" refers to a substance having metallic properties and being composed of two or more chemical elements of which at least one is an elemental metal.

Also, the invention contemplates a process including providing a body component, a portion of whose surface is a directly electroplateable polymeric surface; electrodepositing a nickel-based metal in a layer with one face of the layer durably adherent to the directly electroplateable portion of the surface of the body; possibly depositing additional layers in a fashion to adherently bond these layers among themselves and to the initial nickel-based layer; and depositing an alloy containing tin and cobalt or nickel or combinations thereof, or possibly another Group VIII metal, onto the underlying layers in locations and proportions to form an exterior stratum durably joined to the underlying layers and having an exterior silver-colored metallic character.

The directly electroplateable polymeric composition which forms at least a portion of the surface of the body component of the invention is characterized by:

(a) having a polymeric matrix;

(b) presence of carbon black in amounts sufficient for the overall composition to have an electrical volume resistivity of less than about 1000 ohm-cm., e.g., 100 ohm-cm., 10 ohm-cm., 1 ohm-cm.;

(c) presence of sulfur (including any sulfur provided by sulfur donors) in amounts greater than about 0.1% by weight of the overall polymer-carbon-sulfur composition; and (d) presence of the polymer, carbon and sulfur in said directly electroplateable composition of matter in cooperative amounts required to achieve direct, uniform, rapid and adherent coverage of said composition of matter with an electrodeposited nickel-based metal, thus characterizing the surface as a directly electroplateable polymeric surface.

The minimum workable level of carbon black required to achieve electrical resistivities less than about 1000 ohm-cm. appears to be about 8 weight percent based on the weight of the polymer plus carbon black plus sulfur.

Polymers such as polyvinyls, polyolefins, polystyrenes, elastomers, polyamides and polyesters are suitable for the matrix resin. Selection is made according to the physical properties required of the article. For instance, when the body component is made entirely of a directly electroplateable polymeric composition, handling and dimensional requirements generally dictate that the composition be rigid. In such cases one would choose a matrix polymer which, when combined with appropriate amounts of carbon black and sulfur, would result in a directly electroplateable polymeric composition having a modulus of elasticity either in flexure or in tension of greater than 7000 kg/cm$^2$ (99,355 psi) at 23° C. and 50% relative humidity. Various polymeric resins and compositions for directly electroplateable polymers are referred to, inter alia, in my U.S. Pat. No. 3,865,699, in the Hurley et al U.S. application Ser. No. 827,986 and in my SAE Technical Paper 790218 entitled "Directly Electroplateable Resins".

Good results have been obtained with the directly electroplateable compositions supplied by MPD Technology Corp. under the tradmark CAPREZ DPP.

The electrodeposited tin-containing exterior stratum can be a binary alloy comprising tin and another element from Group VIII of the Periodic Table of Elements. Specifically, tin/nickel alloys and tin/cobalt alloys are reported to have good tarnish and abrasion resistance. Both of these alloys have been suggested as possible substitutes for electrodeposited chromium. It is contemplated that other Group VIII metals, e.g., Pd, Pt, would show superior corrosion resistance in similar tin-based alloys. The corrosion resistance of both tin/-nickel or tin/cobalt may be further enhanced by brief contact (1 to 300 seconds) with aqueous, acidic solutions of chromic acid, chromate or dichromate ions, commonly known as chromating. Alternatively, or in combination, corrosion resistance of the exterior tin-based metal stratum may be further enhanced if necessary by coating with clear or pigmented film forming substances. However, widespread substitution of tin/-cobalt or tin/nickel for chromium has not occurred because of chromium's relatively low cost, ease of plating and satisfactory performance. Applications for tin/-nickel and tin/cobalt exterior electrodeposits are generally in specialized cases, such as barrel plating of small metal parts, which cannot be readily accomplished with electroplated chromium.

Tin/nickel electrodeposits from acidic baths are reported to consist of 50 atomic percent tin/50 atomic percent nickel, (66.9 weight percent tin/33.1 weight percent nickel) with the deposit composition varying only about 3 weight percent either way over a wide range of operating conditions. Details of composition and operating parameters for tin/nickel baths are given on page 338 of Metal Finishing Guidebook, Edited by Nathaniel Hall, 1978. Details of composition and operating parameters for acidic tin/cobalt baths are less well-known than for tin/nickel. It is proposed that an operable acidic tin/cobalt bath would be obtained by substituting cobalt for nickel in the published compositions for tin/nickel baths. Tin/cobalt electrodeposits from acidic baths, by analogy, would consist primarily of SnCo, an alloy of 50 atomic percent tin/50 atomic percent cobalt (66.8 weight percent tin/33.2 weight percent cobalt).

The color and hue of tin/cobalt electrodeposits from alkaline baths is sensitive to operating conditions, indicating that the alloy composition is varied by changing conditions in the alkaline bath. The tin/cobalt alloy electrodeposits from alkaline baths are thought to contain up to about 67 atomic percent cobalt with the balance tin. Desirable proportions of tin and cobalt in the alloy are considered to be about 70 atomic percent tin and 30 atomic percent cobalt. The deposit color attains greater whiteness at increasing percentages of tin, e.g., 80% tin/20% cobalt or even 90% tin/10% cobalt. The deposit color becomes increasingly darker and bluer as the percentage of cobalt is increased, e.g., 60% tin/40% cobalt or 50% tin/50% cobalt (atomic). An alkaline tin/cobalt bath is proposed in Example IV of this disclosure.

Deposits of tin/cobalt alloy are sometimes preferred from the standpoint that their blue-white coloration resembles that of chromium, thereby improving color-matching in assemblies with parts made in different ways. Tin/nickel deposits have a slight pinkish cast which has certain aesthetic appeal but hinders good color matching to chromium plated parts.

The initial nickel-based layer in contact with and adherent to the directly electroplateable polymeric surface can be electrodeposited from known nickel-based metal plating baths. Advantageously, the initial layer and subsequent layers in the interior stratum have nickel contents of about 50% or higher, e.g., 60%, 70%, 80%, 90%, nickel. Watts nickel baths, all-chloride nickel baths, sulfate-chloride nickel baths, all-sulfate nickel baths, and nickel sulfamate containing baths can be used to electrodeposit an initial nickel layer. Good results have been obtained using a Watts bath, which may contain brighteners and other functional additives. Details of operation for these and other nickel baths can be obtained from textbooks on electroplating, e.g., Metal Finishing Guidebook, Edited by Nathaniel Hall, Metals and Plastics Publications, Inc. 1978. Nickel-based alloys with other Group VIII metals, e.g., Ni/Co, Ni/Fe, can be deposited in contact with and adherent to the directly electroplateable polymeric surface from well-known electroplating baths employed for such alloy deposition. Suitable compositions and operational parameters can be obtained from U.S. Pat. Nos. 4,195,117 (Ni/Fe) and 4,191,617 (Ni/Co).

It has been noted that addition of brighteners to the nickel-based plating bath used to deposit the initial nickel-based layer results in improved HSTS performance for the composite of the invention, an effect particularly evident on complex parts in deeply recessed areas.

Additional layers joining the initial electrodeposited nickel-based layer and the exterior tin-based stratum can be advantageously employed to achieve functional, appearance or cost benefits, such as to impart brightness and provide durability to thermal and corrosive environments. For example, additional layers of soft "Watts" nickel followed by bright nickel followed by DurNi* nickel are contemplated to be advantageous in manufacture of complex parts for automotive or other use where both harsh corrosive media and environmental extremes can be encountered. In applications requiring minimum cost, additional layers may include a zinc electrodeposit or may be omitted entirely.

*Registered Trademark and product of Oxy Metal Industries Corporation

Neither the interior stratum nor the exterior stratum need contain copper either as an alloy or pure layer. Both strata can be essentially free of copper. Heretofore electrodeposited copper layers have been found practically necessary in order to ensure longterm thermal cycling durability of electroplated polymers. The ability to achieve excellent results without having copper in the composite structure avoids detrimental effects of green copper staining in corrosive environments and the inherent complications of processing and pollution control involved in depositing copper.

The new composite structure disclosed here also does not require the use of complicated and difficult to control multi-metal alloy strike deposits immediately adjacent to the directly electroplateable polymeric surface. Simple dull or bright nickel-based layers, including pure nickel, suffice, thereby significantly reducing electroplating process complexity, pollution control requirements and overall costs. Specifically, avoidance of nickel-iron strike deposits for articles of exterior automotive application improves the composite corrosion performance by avoiding the potential for red rust staining.

A BRIEF DESCRIPTION OF THE FIGURE

The drawing shows a cross-section of the invention.

Turning now to the accompanying drawing, which is taken in conjunction with the present specification, numeral 10 refers to a tin/cobalt plus nickel plus directly electroplateable polymer embodiment of the composite article of the invention. Article 10 has exterior metal surface 11 which is of a silvery hue. Surface 11 is an exterior surface of tin/cobalt alloy exterior stratum 12 which is adherent to the upper face of interior stratum 13. The interior stratum 13 is a double layer stratum comprising DurNi* nickel layer 13*a* adhering to bright nickel layer 13*b*. The downward face of stratum 13 adheres to the directly electroplateable polymer 14. Article 10 has durable adherence at alloy-nickel junction 15 and nickel-polymer junction 16. Thus, stratum 12 (with surface 11) is joined to directly electroplateable polymer 14.

*Registered Trademark and product of Oxy Metal Industries Corporation

For carrying the process of the invention into practice it is desirable that the directly electroplateable surface be of material selected in light of the hereinbefore discussions of directly plateable polymers.

The layer adjoining the directly electroplateable polymeric surface (the initial electrodeposited nickel-based layer) can be applied by those procedures presently known for achieving initial coverage and growth of electrodeposits on directly electroplateable polymers. In general, the temperature of the electroplating bath used to achieve initial deposition of the nickel-based layer onto the directly electroplateable resin surface should not exceed about 65° C.

For purposes of providing those skilled in the art a further understanding of the invention, the following examples are set forth.

EXAMPLE I

A directly plateable polymeric composition known as CAPREZ DPP* HI-FLOW was injection molded to the configuration of 1-inch hexagonal nuts. The nuts had surfaces satisfactory for electroplating directly without additional surface preparation. A quantity of the molded nuts were mounted as cathodes on an electroplating rack in a bright nickel plating bath and electroplated with nickel to provide a 0.0025 cm. (nominal) thick stratum of bright nickel adjoining the outer surfaces of the nuts. Particulars of the electroplating were:

Bath—Udylite 66**
Current—538 amperes per square meter
Time—30 minutes
Temperature—57° C.

*Registered Trademark of MPD Technology Corp.
**Product of Oxy Metal Industries Corporation The bright nickel plated nuts were rinsed in water. Next, for the exterior stratum, the bright nickel plated nuts, still racked as cathodes, were electroplated with tin/cobalt alloy onto the nickel to deposit a 0.00003 cm. thick layer of a silver-colored tin/cobalt alloy adhering as an exterior stratum over the nickel. The results satisfactorily provided the hex nuts with attractive silvery surfaces resembling freshly cleaned and polished steel. Analysis of the electrodeposited tin/cobalt exterior stratum revealed a composition of approximately 70 atomic percent tin/30 atomic percent cobalt. Particulars of this second plating of Example I are:

Bath—Udylite Achrolyte* (slightly alkaline, pH about 8.0 to 8.6)
Current—100 amperes per square meter
Time—2 minutes
Temperature—43° C.

*Product of Oxy Metal Industries Corporation

Other configurations of metal-polymer composites satisfactorily made according to Example I included water tap strainers and bottle closures.

Satisfactory durability characteristics of Example I articles were confirmed with chemically and thermally accelerated evaluations of long-term corrosion resistance and thermal stability. In CASS (copper accelerated salt spray) exposures of 22 hours duration, all 3 of the 3 specimens (hex nuts) that were exposed passed satisfactorily without suffering green or red rust staining, tarnishing or electrodeposit blistering.

In HSTS (heat soak thermal stability) evaluations with programs of 16 hours in 85° C. air plus 1 hour in room temperature air plus 2 hours in minus 30° air, 2 specimens of Example I were evaluated and both endured successfully without deterioration. The HSTS program is used as an accelerated evaluation of long term durability of bonding of electrodeposits to directly electroplateable polymers.

In TC (Thermal Cycle) evaluations with cycle programs of 2 hours in 85° C. air plus 1 hour in room temperature air plus 2 hours in minus 30° C. air, repeated for 3 cycles, both Example I specimens exposed survived without deterioration.

EXAMPLE II

Injection molded 1-inch hex nuts of CAPREZ DPP HI-FLOW were provided with a multiple layer electrodeposit which had a 0.0023 cm. thick layer of bright nickel electroplated directly onto the nuts and a 0.0003 cm. layer of dispersed particle nickel electroplated onto the bright nickel layer. The bright nickel plating was done as in Example I except the plating time was reduced to 28 minutes. Particulars of plating the dispersed particle nickel were:

Bath—Udylite DurNi
Current—538 amperes per square meter
Time—3 minutes
Temperature—57° C.

The electroplated nuts were then rinsed in water and a 0.00003 cm. exterior stratum of tin/cobalt alloy was electroplated onto the DurNi layer using the bath and plating techniques for depositing the tin/cobalt alloy as in Example I. This resulted in a microdiscontinuous stratum of tin/cobalt alloy. Example II successfully provided hex nuts with attractive silvery surfaces resembling freshly cleaned steel.

Satisfactory durability characteristics of articles made in Example II were confirmed with accelerated evaluations of long term corrosion resistance and thermal stability. In 22 hour CASS exposures, both of the two Example II specimens (hex nuts) exposed passed satisfactorily without suffering green or rust staining, tarnish or electrodeposit blistering. Further, specimens of Example II were subjected to 88 hours of CASS exposure and still did not suffer staining. Moreover, the specimens of Example II successfully resisted pitting corrosion during the 88 hour CASS test.

In HSTS evaluation (programmed as in Example I) of Example II specimens, all 3 of 3 specimens evaluated survived satisfactorily without deterioration.

In a TC evaluation (triple cycle program of Example I) the one specimen evaluated survived the 3 cycles successfully.

In considering results achieved by Example I and II, it is noted that, relative to each other, Example I has special advantages of reduced cost and process complexity and Example II (with a microdiscontinuous stratum of tin/cobalt) has advantages of increased resistance to pitting corrosive attack.

EXAMPLE III

Bodies in forms of wheel hub covers, about 9 cm. diameter and about 6 cm. high were injection molded of CAPREZ DPP HI-FLOW. After individual mounting on a plating rack, an initial electrodeposited layer of about 0.0012 cm. thickness was deposited from a Watts nickel bath onto the surface of the hub covers. This was followed by electrodepositing a second layer about 0.0012 cm. thick of bright nickel from a Udylite 66 bright nickel plating bath. A 0.00003 cm. exterior stratum of silver-colored tin/cobalt alloy was then deposited onto the bright nickel with the hub covers still connected as cathodes on a plating rack. Electroplating the exterior tin/cobalt stratum was done in a Udylite Achrolyte bath. Satisfactory results of silvery metallic surfaces on the hub covers were obtained. Evaluation by the HSTS thermal program of Example I confirmed satisfactory thermal stability.

EXAMPLE IV

As an illustrative example of the invention, molded bodies of CAPREZ DPP HI-FLOW directly electroplateable polymer are electroplated with a 0.00254 cm. stratum of bright nickel adhering to the polymer and then a 0.00003 cm. exterior stratum of silver-colored tin/cobalt alloy is electroplated onto the bright nickel (the interior stratum).

Particulars of the platings are:

| | Bright Nickel | |
|---|---|---|
| Bath Ingredient | Grams/liter | Volume Percentage |
| Nickel Sulfate | 225–375 | — |
| Nickel Chloride | 30–90 | — |
| Boric Acid | 30–40 | — |
| Brighteners | — | 4.0 |

Current—538 amperes per square meter
Time—24 minutes
Temperature—57° C.
pH—4.0

| | Tin/Cobalt |
|---|---|
| Bath Ingredient | Grams/liter |
| Cobalt Sulfate | 5 |
| Stannous Sulfate | 7 |

Current—100 amperes per square meter
Time—1.5 minutes
Temperature—43° C.
pH—8.3

It is understood that a suitable chelating agent is included in the bath to maintain solubility of the tin and cobalt at the pH of 8.3. Common chelating agents are identified on page 39 of Electroplating Point Source Category, Development Document, United States Environmental Protection Agency, February, 1978. Results are satisfactory composite bodies having silver-colored metallic exteriors and good durability characteristics.

EXAMPLE V

In another actual example of the invention, the 9 cm. diameter wheel hub covers, as in Example III, were mounted on a plating rack. A nickel layer of about 0.0025 cm. thick (nominal) was electroplated from a bright bath (Udylite 66) directly onto the surfaces of the hub covers. Electroplating bath parameters for the bright nickel plating were as described in Example I. After water rinsing, a 0.00003 cm. exterior stratum of silver-colored tin/cobalt alloy was then deposited onto the bright nickel with the hub covers still connected as cathodes on a plating rack. Electroplating the exterior tin/cobalt stratum was done in a Udylite Acrolyte bath as in Example I. After evaluation in the HSTS thermal program, the parts showed no blistering or deterioration of bond strength.

To further illustrate advantages of the invention, the following descriptions of results obtained with other composite articles, different from the invention, are presented.

Chromium Composite A 1-inch hexagonal nuts were electroplated with bright nickel as in Example I. After rinsing in water, the bright nickel plated nuts, still racked as cathodes, were electroplated with chromium onto the nickel to deposit a 0.00003 cm. thick layer of silver-colored chromium adhering as an exterior stratum over the nickel. Chromium was deposited from a standard chromium plating bath, such as described on page 194 of the Metal Finishing Guidebook, Nathaniel Hall Editor, 1978. Particulars of the chromium plating were:

Current—1900 amperes per square meter
Time—1.5 minutes
Temperature—45° C.

The nickel-chromium plated nuts were exposed to the HSTS program at the same time as those from Example I. After the HSTS test, the nickel-chromium plated nuts of Chromium Composite A showed extensive electrodeposit blistering and peeling of the electrodeposit showed severe deterioration of adhesion.

Chromium Composite B 9 cm. diameter wheel hub covers were first electroplated with a 0.0025 cm. thick bright nickel deposit as in Example V. After water rinsing, a 0.00003 cm. exterior stratum of chromium was deposited onto the bright nickel with the hub covers still connected as cathodes on a plating rack. Chromium electroplating was done as in Chromium Composite A. After evaluation in the HSTS program, massive blistering of the electrodeposit was observed and residual bond strength was nil.

EXAMPLE VI

To further demonstrate the invention, performance data were obtained using nickel alloy strike electrodeposits. The data were obtained using articles injection molded from directly electroplateable polymeric compositions. The articles had the shape of hollow hemispheres of diameter 3.3 cm. and wall thickness 0.25 cm. These articles were chosen to demonstrate performance over a range of electroplating current densities on a single article. The outside, convex, surface of the hemispheres experiences relatively high current densities during plating while the inside, concave, surface experiences relatively low current densities.

The hollow hemispheres were molded from two different directly electroplateable polymeric compositions. The first was CAPREZ DPP HI-FLOW, a commercially available material based on high impact polypropylene copolymer. The second material used was blended using a polypropylene homopolymer as a base and is designated in this specification as Formulation A.

A quantity of both CAPREZ DPP HI-FLOW and Formulation A hemispherical articles were mounted as cathodes on an electroplating rack and electroplated directly in a nickel/cobalt alloy plating bath using the following procedure.

Step 1—1 Volt impressed potential for 1.5 minutes.

Step 2—2 Volts impressed potential for 2 minutes, at which point full metal coverage of the parts had been achieved.

Step 3—1.5 minutes at 0.55 amperes per square decimeter (amp/dm$^2$)

The nickel/cobalt alloy bath used to achieve coverage had the following characterization.

$Ni^{++}$—74.6 grams/liter
$Co^{++}$—4.54 grams/liter
$SO_4^{-}$—107.8 grams/liter
$Cl^{-}$—15.66 grams/liter
$H_3BO_3$—42.1 grams/liter
pH—3.8
Temperature—54° C.
Wetting Agent—0.3 percent It is noted that the nickel/cobalt bath composition, operational parameters and procedure stated above are essentially identical to those disclosed and taught by Hurley et al. (U.S. Pat. No. 4,191,617) for deposition of a strike layer containing about 36 percent cobalt, balance nickel.

After initial striking with the nickel/cobalt alloy, the rack of parts was further plated with a 0.0026 cm.(average thickness) layer of bright nickel. Particulars of the bright nickel plating were.

Bath—Udylite 66
Current—538 amperes per square meter
Time—24 minutes
Temperature—55° C.

After rinsing in water, the bright nickel plated articles, still racked as cathodes, were electroplated with tin/cobalt alloy onto the bright nickel to deposit a 0.000025 cm. thick layer of a silver-colored tin/cobalt alloy adhering as an exterior stratum over the nickel. Particulars of the tin/cobalt alloy plating were as follows.

Bath—Udylite Achrolyte
Current—80 amperes per square meter
Time—2 minutes
Temperature—38° C.

The nickel/cobalt—bright nickel—tin/cobalt plated articles were placed at 85° C. for 16 hours in air, then cooled to room temperature, 21° C. Examination of the parts revealed the following.

CAPREZ DPP Articles—No blistering on either the external (convex) or internal (concave) surfaces. 3 of 3 samples tested perfect.

Formulation A Articles—No blistering on either the external (convex) or internal (concave) surfaces. 3 of 3 samples tested perfect.

To further illustrate advantages of the invention, the following description of results obtained with other composite articles, different from the invention, are presented.

Chromium Composite C

A second quantity of the hollow hemispheres of CAPREZ DPP and Formulation A were racked as cathodes on a plating rack as was done for Example VI. Using bath parameters, compositions and operating procedures identical to those used for Example VI, the articles were plated with first the nickel/cobalt strike layer, then the 0.0026 cm. (average thickness) bright nickel layer as was done for the Example VI articles. After rinsing in water, the articles, still racked as cathodes, were electroplated with chromium onto the bright nickel surface to deposit a 0.000038 cm. thick layer of silver-colored chromium adhering as an exterior stratum over the nickel. Particulars of the chromium plating were as follows.

Bath—M & T LUMA-CHROME*
Concentration—240 grams per liter
Current—1860 amperes per square meter
Temperature—42° C.
Time—2 minutes.

*Registered Trademark and Product of M & T Chemical Corporation.

The nickel/cobalt—bright nickel—chromium plated articles were placed at 85° C. for 16 hours in air at the same time as those from Example VI, then cooled to room temperature, 21° C. Examination of the parts revealed the following.

CAPREZ DPP Articles—2 parts were tested. 1 part had substantial blistering on the inside (concave) surface, and no blistering on the outside (convex) surface. The second part tested survived without blistering.

Formulation A Articles—3 parts were tested. All three of the parts had substantial blisters on the inside (concave) surface. Some blistering was observed on the outside (convex) surface on 2 of 3 parts tested.

In comparing the results of Example VI and Chromium Composite C, one observes that the use of the tin/cobalt exterior stratum in Example VI gives markedly improved performance in accelerated thermal testing. The improved performance of the tin/cobalt exterior stratum was observed for both of the two different directly electroplateable polymeric compositions tested.

It is contemplated that the use of nickel alloy strike layers in conjunction with a tin-based exterior stratum may give performance superior to that expected from either when used alone. For example, a second series of tests were performed wherein plated parts were exposed to 64 hours at 94° C. in air. Five CAPREZ DPP hemispheres, plated with (nickel/cobalt—bright nickel—tin/cobalt) as in Example VI were tested and all five survived without any evidence of blistering or bond deterioration. Five CAPREZ DPP hemispheres, plated with (nickel/cobalt—bright nickel—chromium) as in Chromium Composite C, were simultaneously tested and all five developed substantial blistering on the inside (concave) surface.

The foregoing compositions, resins, metals and baths are illustrative of materials that are marketed in varieties and ranges usable in the invention. For instance, the CAPREZ DPP resin in the Examples is illustrative of a broader range of compositions containing polymers, carbon black and sulfur. Also, the Udylite 66 and Achrolyte baths are illustrative of various other bright nickel and tin/cobalt baths used for electrodeposition or chemical deposition of nickel-based metals and tin/-cobalt alloys.

The present invention is particularly applicable to providing manufactured composite articles expected to have long-term (two years) durability against thermal extremes and possibly corrosive conditions. It is clear from the data presented that the use of tin/cobalt or tin/nickel alloys, when used in conjunction with a directly electroplateable plastic substrate, is more than a simple substitution for the widely used chromium and results in unexpected improvement in long-term durability of the directly electroplateable plastic/electrodeposit composite. Tin/cobalt or tin/nickel exterior deposits are asserted to be uniquely suitable and advantageous when used in a composite structure with a directly electroplateable plastic substrate containing carbon black, sulfur and polymer matrix, especially under production plating conditions and on highly complex parts where efforts using "all-nickel plus chromium" electrodeposits have failed.

It has been noted that the prior art offers no satisfactory system for elimination of troublesome copper interlayers in production of complex, chromium plated directly electroplateable parts requiring long term durability. It is proposed that the unique, and independent, beneficial results achieved by replacing chromium with tin/cobalt or tin/nickel will exist over and above any prior improvements achieved in other ways (i.e., through manipulation of the directly electroplateable polymer substrate composition, underlying electrodeposit system, or strike layer) and thereby greatly expand permissible operating parameters and part geometries to allow the desired elimination of copper in production and on complex parts.

The present invention is particularly applicable to providing manufactured articles for use as handles, emblems and other decorative trim, knobs, fasteners, automotive wheel covers and hubs, grilles, headlamp surrounds and mirror housings, plumbing components such as faucet housings, strainers and non-pressure piping, escutcheons, tape cases and other hardware components, machine and tool housings, and enclosures to provide shielding for electronic devices.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A metal-polymer composite article for use where long term integrity of the composite article is required consisting essentially of a body component containing a directly electroplateable polymeric material; an exterior metallic stratum of a tin-based alloy composed essentially of tin, nickel, cobalt and mixtures thereof; and an interior metallic stratum disposed between, and durably joined to, the body and the exterior stratum and having included in the interior stratum a nickel-based alloy electrodeposit selected from the group consisting essentially of nickel cobalt and nickel iron alloy adhering to directly electroplateable polymeric material in the body.

2. A composite article as set forth in claim 1 wherein the directly electroplateable polymeric material comprises a polymeric resin matrix and has carbon black and sulfur in weight proportions of at least 8% carbon black and 0.1% sulfur based on the weight total of matrix resin-plus-carbon-black-plus sulfur.

3. A composite article as in claim 1 wherein the interior stratum consists of a single electrodeposited layer.

4. A composite article as set forth in claim 1 characterized by having the body and strata joined together with durability sufficient for satisfactorily surviving, without blistering or cracking, a thermal test exposure for composite integrity, which test exposure would cause blistering or cracking of a chromium plated article alike in every respect to the claimed article except for having in the place of the tin-based exterior stratum of the claimed article a chromium exterior stratum electrodeposited at a current density of 1900 amperes per square meter for 1.5 minutes in a standard chromium electroplating bath at 45° C.

* * * * *